US006973865B1

(12) United States Patent
Duselis et al.

(10) Patent No.: US 6,973,865 B1
(45) Date of Patent: Dec. 13, 2005

(54) DYNAMIC POINTING ACCURACY EVALUATION SYSTEM AND METHOD USED WITH A GUN THAT FIRES A PROJECTILE UNDER CONTROL OF AN AUTOMATED FIRE CONTROL SYSTEM

(75) Inventors: Uldis Duselis, Indianapolis, IN (US); Jeffrey Scott Eyster, Camby, IN (US); Jesica Renee DeHerdt, Indianapolis, IN (US); Michael Frederick Hampton, Zionsville, IN (US)

(73) Assignee: Raytheon Company, Waltham, MA (US)

( * ) Notice: Subject to any disclaimer, the term of this patent is extended or adjusted under 35 U.S.C. 154(b) by 122 days.

(21) Appl. No.: 10/734,446

(22) Filed: Dec. 12, 2003

(51) Int. Cl.[7] ..... F41G 3/06
(52) U.S. Cl. ..... 89/41.05; 89/41.17; 434/19
(58) Field of Search ..... 89/41.05, 41.06, 89/41.17; 434/16, 19, 20

(56) References Cited

U.S. PATENT DOCUMENTS

| | | | | |
|---|---|---|---|---|
| 3,453,385 A * | 7/1969 | Capellaro | ..... | 348/78 |
| 4,276,028 A | 6/1981 | Gwynn | ..... | 434/20 |
| 4,650,419 A | 3/1987 | Francke et al. | ..... | 434/16 |
| 5,379,676 A * | 1/1995 | Profeta et al. | ..... | 89/41.05 |
| 5,686,690 A * | 11/1997 | Lougheed et al. | ..... | 89/41.17 |
| 6,386,879 B1 | 5/2002 | Varshneya et al. | ..... | 434/16 |
| 6,499,382 B1 * | 12/2002 | Lougheed et al. | ..... | 89/41.05 |

FOREIGN PATENT DOCUMENTS

| | | |
|---|---|---|
| EP | 0 160 123 A2 * | 11/1985 |
| GB | 2 107 835 A * | 5/1983 |

* cited by examiner

*Primary Examiner*—Stephen M. Johnson
(74) *Attorney, Agent, or Firm*—Daly, Crowley, Mofford & Durkee, LLP

(57) ABSTRACT

A dynamic pointing accuracy evaluation system is used in conjunction with a weapon system that includes a gun that fires a projectile from a barrel toward a target. The firing of the projectile occurs upon receipt of a shoot command from an automated fire control system that is activated by a firing command generated by a gunner viewing the target through a gun sight. The dynamic pointing accuracy evaluation system includes a firing-image camera mounted to a barrel of the gun and aimed parallel to a boresight of the gun. A photo trigger command line transmits a photo trigger command from the fire control system to the firing-image camera. The firing-image camera produces a firing image upon receipt of the photo trigger command. A computer receives the firing image and determines a calculated strike location from the firing image and from a range of the gun to the target.

17 Claims, 2 Drawing Sheets

DYNAMIC POINTING ACCURACY EVALUATION SYSTEM AND METHOD USED WITH A GUN THAT FIRES A PROJECTILE UNDER CONTROL OF AN AUTOMATED FIRE CONTROL SYSTEM

This invention relates to the evaluation of gun-based weapon systems and gunners and, more particularly, to a system for evaluating the performance of the gunner, the fire control system, and the mechanical elements of the weapon system.

BACKGROUND OF THE INVENTION

The main weapon system of a modern military tank such as the M60A3 tank is a gun that fires projectiles responsive to the firing command of a human gunner. However, the firing command does not go directly from the gunner to the gun. The firing command is supplied to a fire control system, typically a director-type fire control system, that coordinates the firing command with other information, such as the motion of the gun, the motion of the vehicle, the motion of the target, the range of the target, the type of projectile, environmental conditions, and other information. The fire control system constantly performs and updates the ballistic solution for the potential target. The fire control system typically calculates a desired gun-sight offset in elevation (i.e., how much of an angle above the target the gun should be pointed to hit the target) and the desired gun-sight offset in azimuth (i.e., how much of an angle left or right of the target the gun should be pointed to hit the target). With this information and the constant measurements of the actual gun-to-sight offsets in elevation and azimuth, the fire control system constantly calculates the error values between the desired offsets and the actual offsets. These error values are used to reposition the gun and to determine when the error values are sufficiently close to zero that a shot would be of sufficiently high probability for a hit (alternatively stated, is inside the "coincidence window").

After receiving the firing command from the gunner and performing the fire-control calculations, the fire control system produces a shoot command that actually fires the gun at the appropriate moment. Thus, the fire control system takes into account many factors that cannot be readily evaluated quickly by the human gunner, while the gunner makes the decisions on target selection and the time at which the firing sequence is started.

In order to evaluate the performance of the fire control system and to train the gunner to work with the fire control system under a wide variety of conditions, the conventional practice is to perform a series of live-fire tests. In these tests, the tank and its crew, including the gunner, are transported to a live-fire range. A statistically significant number of rounds are fired under various conditions, such as the tank standing still, and the tank moving over various surfaces and at various speeds, and under a variety of weather conditions and using a variety of types of ammunition. These live-fire tests are expensive to perform, as the transportation costs and operating costs are high, and the cost of each round fired is typically about $500.

Additionally, the live-fire tests have shortcomings in regard to the results. The accuracy in hitting the target with the projectile depends upon variations in extraneous factors other than the gunner and the tank system, such as the variations in the propulsive and flight properties from projectile to projectile ("ammunition dispersion"), and the wind and the weather ("environmental dispersion"). These factors cannot be maintained constant in a live-fire test series, so that there is always some uncertainty as to whether the statistical results of the live-fire test series reflect the performance of the gunner and the weapon system, or whether the extraneous dispersion factors are the dominant effect.

Various attempts have been made to improve upon the present approach. Motion tracking techniques are used to determine the positions of the gun and the site used by the gunner, but this approach cannot determine the pointing accuracy of the weapon system. Smaller caliber, inexpensive test projectiles may be used, but they are even more subject to the extraneous factors. Tank simulators are employed in early training of tank crews, but do not provide a sufficiently realistic simulation in advanced training of the actual field conditions that the tank crew will experience, such as bouncing, vibration, and noise for the particular tank that the gun crew will use.

There is a need for an approach to evaluating and training gunners, and evaluating the tank weapon system, which is less expensive than the current approach and also is not affected by the extraneous factors. The present invention fulfills this need, and further provides related advantages.

SUMMARY OF THE INVENTION

The present approach provides a dynamic pointing accuracy evaluation system that is used to evaluate the performance of the weapon system and the gunner of a gun-based weapon system that uses an automated fire control system. The evaluation is accomplished without the influence of extraneous factors such as ammunition dispersion and environmental dispersion. Consequently, the results focus on the hardware and software of the weapon system, and on the performance of the gunner. Information about the performance of the weapon system is useful in developing engineering improvements to the weapon system. Information about the performance of the human gunner is useful in training and screening practices.

The present approach has the further desirable feature that it need not utilize any live firing of the gun. Consequently, the weapon system and its crew need not be moved to a live-firing range, and the dynamic pointing accuracy evaluation may be performed essentially anywhere. The approach is therefore far less expensive than live-fire testing, because range-use, transportation, and consumables costs are avoided. The present approach may optionally be used in conjunction with life firing to gain even more information.

In accordance with the invention, a dynamic pointing accuracy evaluation system is used in conjunction with a weapon system including a gun that fires a projectile from a barrel toward a target. The firing of the projectile occurs upon receipt of a shoot command from an automated fire control system that is activated by a firing command generated by a gunner viewing the target through a gun sight. The dynamic pointing accuracy evaluation system comprises a firing-image source having a known imaging relation relative to a pointing direction of the barrel of the gun. An imaging trigger command line transmits an imaging trigger command from the fire control system to the firing-image camera, preferably at the same time that the fire control system generates the shoot command. The firing-image source produces a firing image upon receipt of the image trigger command. A computer receives the firing image and determines a calculated strike location from the firing image and from a range of the gun to the target.

The firing-image source may be of any operable type. Preferably, it is a camera that operates in the visible or infrared wavelength range, and most preferably a digital camera. The firing-image source is mounted in a known relation relative to the pointing direction of the barrel of the gun and so that the firing-image source moves with the barrel of the gun.

The range of the gun to the target is desirably determined for the calculation of the strike location. The range finder is preferably the range finder of the fire control system, such as a laser or radar range finder, whose output signal is provided to the dynamic pointing accuracy evaluation system. The range finder thus provides to the computer an actual range from the gun to the target associated with the time at which the photo trigger command is transmitted. Other information available from the fire control system, such as vehicle cant, gun angle, and offset error are also preferably provided to the dynamic pointing accuracy evaluation system, for evaluating possible errors in the fire control system and its relation to the vehicle and to the human gunner.

In displaying the results of the evaluation, the computer preferably contains a reference image of the target taken by the camera relative to the pointing direction of the barrel of the gun. The strike location is superimposed upon the reference image. The computer may also present the results of multiple evaluations in order to obtain a statistical picture of the performance. Statistical information may be presented either in a scatter graph of the strike locations relative to the target, or in a numeral form.

In a further embodiment, a gun-sight camera produces a gun-sight image upon receipt of the firing command and transmits the gun-sight image to the computer. The gun-sight image is the image viewed by the gunner through the gun sight. The use of this gun-sight image in conjunction with the strike-location information permits the judgment and skill level of the gunner to be evaluated in regard to selecting targets and sending the firing command.

A method for evaluating dynamic pointing accuracy is used in conjunction with a weapon system including a gun that fires a projectile from a barrel toward a target. The gun is fired upon receipt of a shoot command from an automated fire control system that is activated by a firing command generated by a gunner viewing the target through a gun sight. The method comprises the steps of the gunner sending a firing command to the automated fire control system. The automated fire control system sends a shoot command to the gun responsive to the firing command, and also sends a photo trigger command to a firing-image camera mounted on the barrel of the gun and tracking the movement of the barrel of the gun, responsive to the firing command. The method further includes the firing-image camera producing a firing image responsive to the photo trigger command and sending the firing image to a computer, and the computer determining a calculated strike location from the firing image and a range of the gun to the target. Compatible features and steps discussed herein are operable with the method.

The present approach achieves its evaluation of the dynamic pointing accuracy of the weapon system without the necessity of any live firing (although it may be used in conjunction with live firing, if desired to obtain additional information). The evaluation without live firing is accomplished with images and calculations, so that ammunition dispersion and environmental dispersion are not factors in the evaluation. The evaluation is therefore directed solely to the performance of the hardware and software of the weapon system, and the performance of the gunner and the rest of the tank crew. The evaluation of the dynamic pointing accuracy is also inexpensive and may be performed essentially anywhere, important considerations in a budget-conscious military where some units may not have ready access to live-firing ranges. Because it is inexpensive, it is feasible to perform the evaluations under a much wider range of conditions than is possible with live-fire evaluations. Evaluation of the hardware and software of the weapon system, evaluation of the gunner, and training of the gunner may therefore be more complete and extensive than possible with live-fire testing. The present approach may also be used in conjunction with live firing of the gun, in which case the dynamic pointing accuracy evaluation system allows the evaluation of ballistic and environmental dispersions separate from the evaluation of system and gunner performance.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
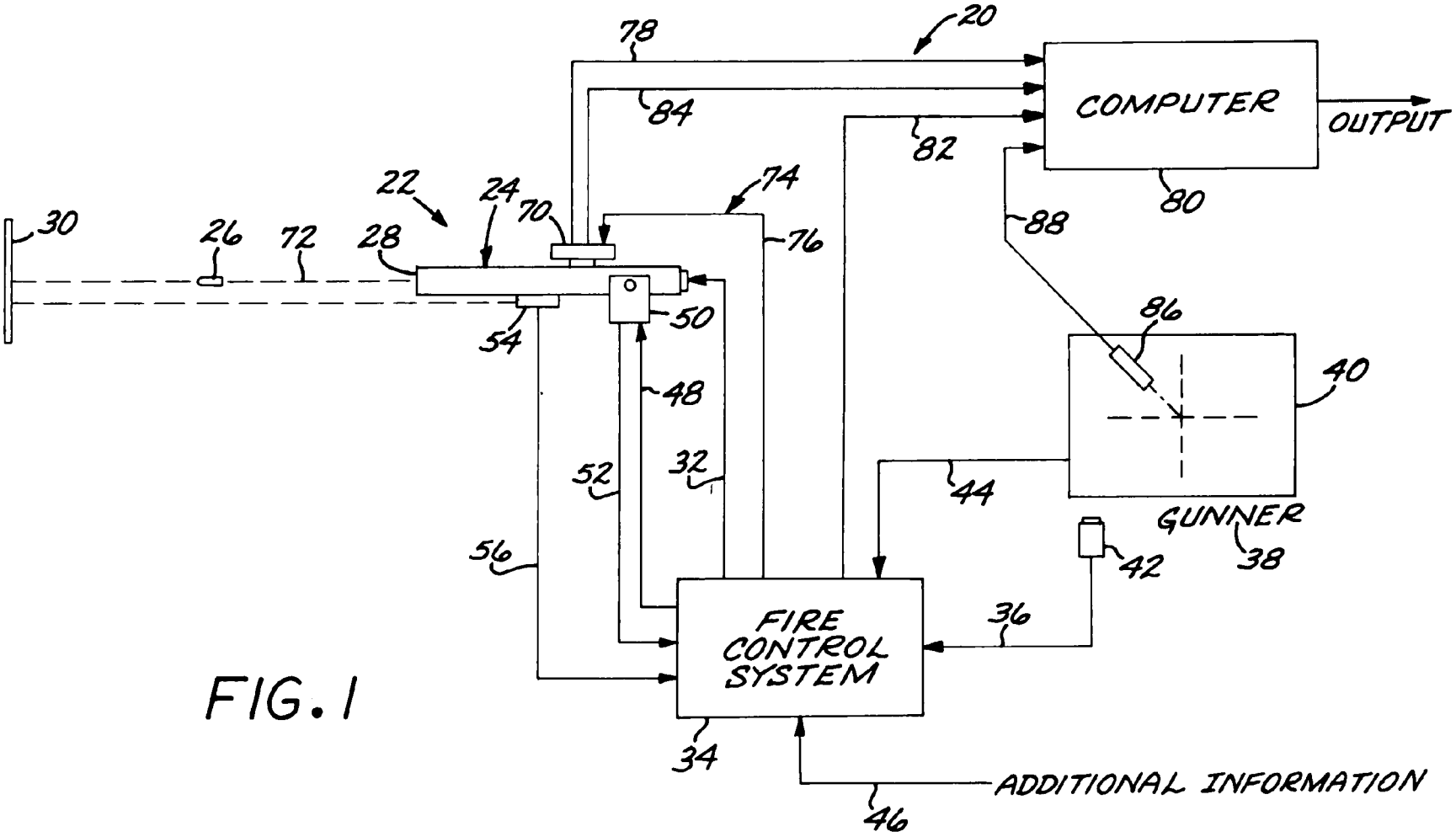
FIG. 1 is a block diagram of an embodiment of a dynamic pointing accuracy evaluation system used in conjunction with a weapon system.

FIG. 1 schematically depicts a dynamic pointing accuracy evaluation system 20 used in conjunction with a weapon system 22. The weapon system 22 includes a gun 24 that fires a projectile 26 from a barrel 28 toward a target 30. The gun 24 fires upon receipt of a shoot command 32 from an automated fire control system 34 that is activated by a firing command 36. The gun 24 and the fire control system 34 are each independently gyroscopically stabilized. The firing command 36 is generated by a human gunner 38 viewing the target 30 through a gun sight 40. The gunner 38 manually generates the firing command 36 by pressing a firing button 42 or the like.

The fire control system 34 receives gun sight pointing information 44 from the gun sight 40. The gun sight pointing information 44 indicates the location at which the gun sight 40 is being pointed by the human gunner 38. The fire control system 34 also receives additional information 46 of various types, from a variety of sensors. The additional information 46 includes, for example, environmental information such as wind velocity and direction, ammunition information about the nature of the ammunition that is being fired, platform-motion information about the movement of the platform (the tank or other vehicle) upon which the gun 24 is mounted, and target-motion information about the movement of the potential target 30. Positional feedback 52 that shows the actual traverse-elevation position of the gun 24 is also provided back to the fire control system 34 from the gun mount. A range finder 54 such as a laser range finder determines the distance from the gun 24 to the target 30 and provides the range 56 to the fire control system 34.

The fire control system 34 uses this information to perform and update the ballistic solution for the potential target 30. The fire control system 34 typically calculates a desired gun-sight offset in elevation (i.e., how much of an angle above the target 30 the barrel 28 of the gun 24 should be pointed for the projectile 26 to hit the target 30) and the desired gun-sight offset in azimuth (i.e., how much of an angle left or right of the target the gun should be pointed to hit the target 30). With this information and the constant measurements of the actual gun-to-sight offsets in elevation and azimuth, the fire control system 34 constantly calculates the error values between the desired offsets and the actual offsets. These error values are used to reposition the barrel 28 of the gun 24 and to determine when the error values are sufficiently close to zero that a shot would be of sufficiently high probability for a hit (alternatively stated, is inside the "coincidence window"). The calculated traverse-elevate error commands 48 are sent to the motor drive 50 of the gun 24 to correct the pointing of the barrel 28 of the gun 24.

In operation, the gunner 38 selects a target 30 and aims the gun sight 40 at the target 30. When the gunner 38 judges that the barrel 28 of the gun 24 is sufficiently on target, he presses the firing button 42 to send the firing command 36 to the fire control system 34. However, the fire control system 34 does not necessarily immediately respond by sending the shoot command 32 to the gun 24. For example, if the tank is moving over rough terrain and the barrel 28 is being bounced in a manner that causes it to be wrongly positioned, the fire control system 34 does not send the shoot command 32 until it determines that the gun 24 is properly positioned such that the expected trajectory of the projectile 26 is judged to be within a mathematically defined coincidence window that includes the target 30. Only then is the shoot command 32 sent to the gun 24 to fire the projectile 26.

Such weapon systems 22 are known in the art. Ideally, they perform perfectly, and the performance of the human gunner, the mechanical elements of the weapon system, and the control elements of the weapon system all perform perfectly and in perfect coordination. The practicalities are somewhat different, however. The proper functioning of the weapon system 22 depends upon a human factor, the skill and judgment of the gunner 38, and hardware/software factors, including the day-to-day operation of the fire control system 34, and the coordination between the human gunner and the hardware and software. The criterion for proper functioning is whether the projectile 26 hits the target 30 in combat or a realistic combat simulation. To achieve this result, a good deal of training and fine-tuning of the weapon system 22 are required.

To test whether the various parts and inputs to the weapon system 22 are performing properly so as to place the projectile 26 on the target 30, conventional practice is to perform live firing of projectiles in a sufficient number to establish statistically significant patterns, under a variety of conditions. This approach has the drawbacks discussed earlier.

The present invention provides a simulation of live firing that may be used to evaluate the mechanical and software components of the weapon system 22, the performance of the gunner 38 (as well as the rest of the tank crew), and the coordination between the gunner 38 and the weapon system 22. This approach may be used to the mechanical/software performance of the weapon system 22, and also to train the gunner 38. In an embodiment of the present approach, a firing-image camera 70 is pointed roughly parallel to a boresight 72 of the barrel 28 of the gun 24. The boresight 72 is the cylindrical axis of the generally cylindrical (except for rifling) internal wall of the barrel 28. The firing-image camera 70 has a known imaging relation relative to a pointing direction (i.e., the boresight 72) of the barrel 28. The firing-image camera 70 follows the movement of the pointing direction or boresight 72 of the barrel 28.

In a preferred approach, the firing-image camera 70 is mounted to the barrel 28 of the gun 24. The firing-image camera 70 is aimed roughly parallel to the boresight 72 of the barrel 28 of the gun 24, although it may be pointed to a lower-elevation angle than the barrel 28 when the barrel 28 is elevated to high angles for a long-distance shot. The use of the reduced-elevation angle for the firing-image camera 70 allows the target 30 to be kept in the image of the firing-image camera 70 when the target 30 is far away from the gun 24. Typically, in the case of a weapon system 22 used on a tank such as the M60A3 tank, the camera 70 is mounted to a searchlight bracket that projects upwardly from the barrel 28. In this particular configuration, the line of sight of the firing-image camera 70 is parallel to, and about 13 inches laterally separated from, the boresight 72 of the gun 24. As the barrel 28 moves azimuthally and elevationally, the firing-image camera 70 follows that same movement.

The firing-image camera 70 may be any suitable imaging device that serves as a source of an image. It is preferred that the firing-image camera 70 be a digital camera operable in the visible and/or the infrared wavelength ranges.

A photo trigger command line 74 transmits a photo trigger command 76 from the fire control system 34 to the firing-image camera 70. The firing-image camera 70 produces a firing image 78 upon receipt of the photo trigger command 76.

A computer 80 receives the firing image 78 and determines a calculated strike location from the firing image 78 and from the range of the gunsight 40 to the target 30 and the gun barrel-camera relationship determined from a previously stored reference image. The range may be provided as a manual input to the computer 80, but is preferably provided as the measured range 56 output of the range finder 54. The range 56 is preferably measured at the time that the photo trigger command 76 occurs. This range 56 data and other pertinent data, such as vehicle cant, gun position including barrel elevation and azimuth angles, and offset error, is provided from the fire control system 34 to the computer 80 as data 82.

The strike location is the location, in a vertical target plane lying perpendicular to a line extending between the gun 24 and the target 30, at the target range that is calculated to be struck by the projectile 26. The strike location is calculated by first determining the intercept location at which the boresight 72 of the gun 24 intercepts the target plane, from the central aim point of the firing image 78 and the known lateral offset of the firing image camera 70 from the boresight 72. The intercept location is adjusted because the projectile 26 does not travel on a straight line, but instead falls below the projected boresight line over the course of its flight path due to gravity. The amount of fall may be calculated using standard relations. The amount of fall may also be determined empirically for each particular projectile type, or from standard tables of the amount of fall as a function of range for standard projectile types. The use of such tables is preferred to a calculation of the amount of the fall of the projectile, because the amount of fall depends upon the frontal area and aerodynamics of the projectile, and that information is most accurate when determined empirically and presented in tabular form. The calculated strike location coordinates, at the target plane, in the horizontal (azimuthal) direction are those taken from the firing-image photograph; the strike location coordinates in the vertical direction are the intercept location minus the amount of fall of the projectile during its flight.

The calculated strike location may be reported simply as coordinates. A more meaningful presentation is to superimpose the calculated strike location on a photo of the target. For this purpose, a reference image 84 may be obtained before or after the dynamic pointing accuracy evaluation is performed. The reference image 84 provides a known imaging relation of the firing-image camera 70 relative to the pointing direction (i.e., the boresight 72) of the barrel 28 of the gun 24. The reference image 84 is taken by the camera 70 but with the gun 24 stationary and with the barrel 28 and the target 30 both in the image, usually prior to or after conducting the further evaluation exercises.

The preceding approach provides the basic data for evaluation of the weapon system 22 to determine the amount by which the calculated strike location missed the target. The amount of the miss depends both upon the skill of the gunner and the operation of the hardware and software of the weapon system 22. Additional information to quantify what portion of the miss is due to the gunner 38 and what portion is due to the hardware and software of the weapon system 22 may be obtained from an optional gun-sight camera 86 that produces a gun-sight image 88 upon receipt of the firing command 36 and transmits the gun-sight image 88 to the computer 80. The cross-hair of the gun-sight image 88 indicates the point at which the gunner 38 gave the firing command 36, which in turn specifies the center of the coincidence window to the fire control system 34. If, for example, the gunner 38 is consistently off-target in giving the firing command, the fire control system 34 will attempt to fire the projectile 26 to that off-target location so that the amount of the miss may be largely attributed to gunner error. If the gunner 38 is consistently on-target in giving the firing command, then the magnitude of the misses may be attributed to the fire-control system 34 or to the mechanical elements of the weapon system 22, and the source of the problem may be identified with further testing. In this manner, the individual human and non-human components, and their cooperation, may be optimized.

Figure 2:
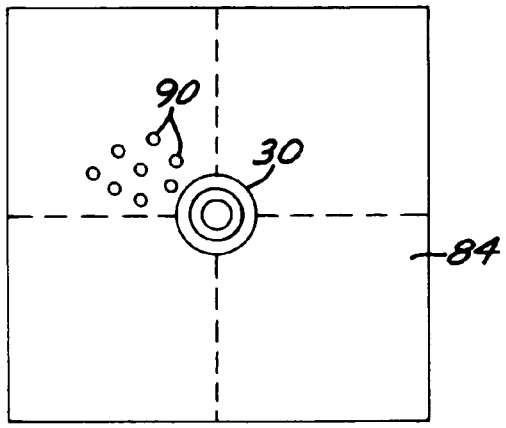
FIG. 2 is a schematic depiction of a reference image of a target, with calculated strike locations indicated.

FIG. 2 is an example of the results and use of the present approach. Eight calculated strike locations 90 are recorded in relation to a target 30 in the reference image 84. (Typically, a larger number of calculated strike locations 90, on the order of about 30 calculated strike locations, are required for statistical significance in practice.) In this example, all of the calculated strike locations are high and to the left of a center of the target 30. This pattern may be due to gunner error in consistently aiming high and to the left, as may be determined from the gun-sight images 88. In that case, additional training of the gunner 38 would be required so correct this systematic error. On the other hand, if the gun-sight images 88 showed that the gunner was consistently firing on target, then the systematic error would be traced to either the fire control system 34 or to some problem with the tank hardware. The present approach may therefore be used for both the evaluation and training of gunners 38, and also for the engineering development and improvement of the tank systems and the fire control system 34.

Figure 3:
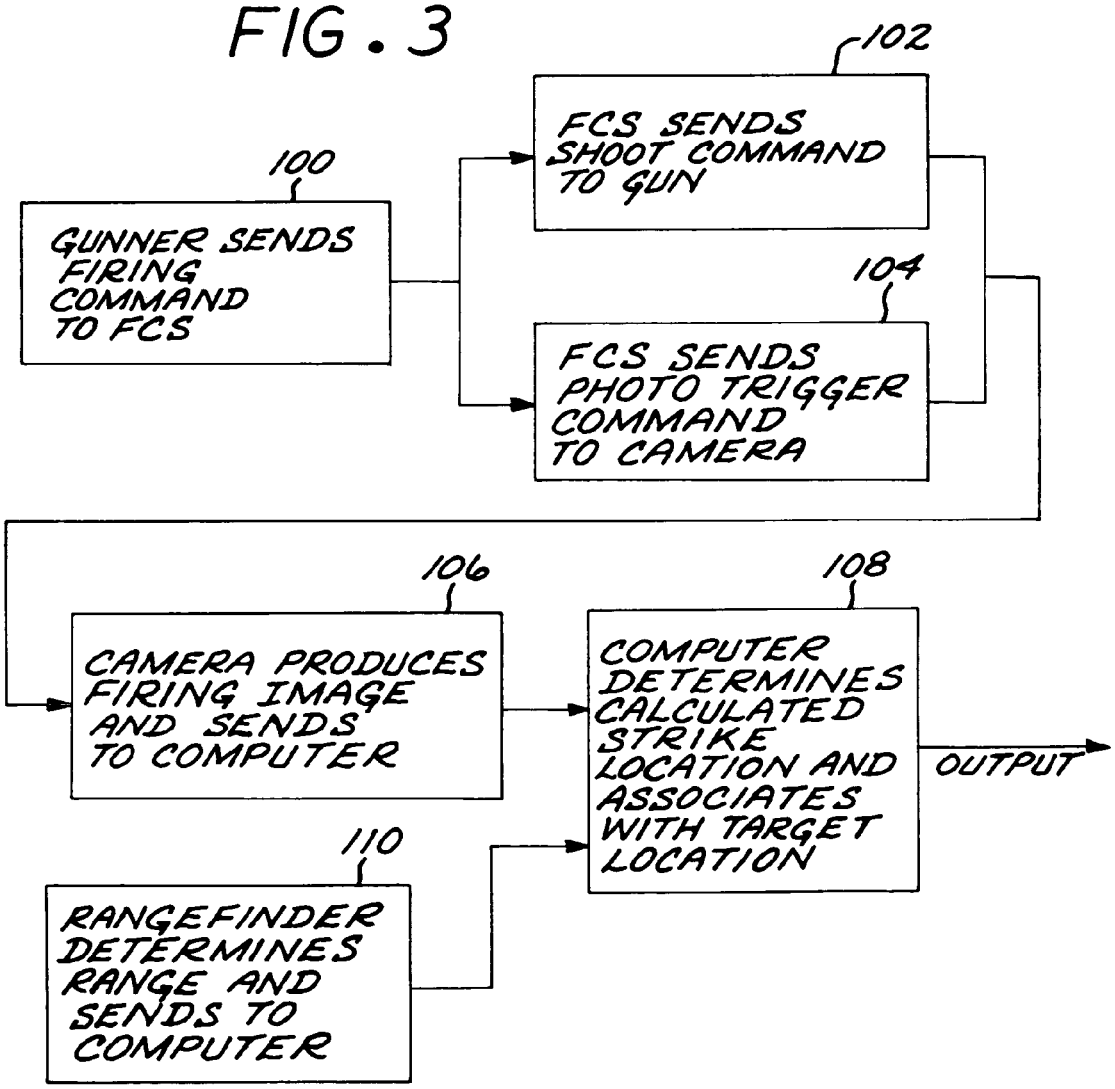
FIG. 3 is a block flow diagram of a method for practicing an embodiment of the method of the invention.

FIG. 3 depicts a preferred approach for practicing an embodiment of the method of the invention. A method for evaluating dynamic pointing accuracy with the weapon system 22 as described previously involves the gunner 38 sending the firing command 36 to the automated fire control system (FCS), step 100. The automated fire control system 34, after performing its normal operations, sends the shoot command 32 to the gun 24 responsive to the firing command 36, step 102. The automated fire control system 34 also sends the photo trigger command 76 to the firing-image camera 70 mounted on the barrel 28 of the gun 24 and aimed roughly parallel to the boresight 72 of the gun 24, step 104, responsive to the firing command 36. (If there is a gun-sight camera 86, a photo trigger command is also sent to it at this time.) The firing-image camera 70 produces the firing image 78 responsive to the photo trigger command 76, and sends the firing image 78 to the computer 80, step 106. The computer 80 determines the calculated strike location from the firing image 78 and from the range of the gun 24 to the target 30, step 108. The range information is preferably automatically provided by the range finder 54, step 110, and sent to the computer 80 via the fire control system 34. Other operable features discussed herein may be used in relation to this method.

The present approach has been reduced to practice with the structure of FIG. 1 and using the methodology of FIG. 3, specifically for the weapon system of the M60A3 tank. It has been found to operate in the manner discussed herein.

The present approach provides an apparatus, system, and method for evaluating the dynamic pointing accuracy of gun-based weapon systems that produces better results, with significantly less expense, than conventional live-fire testing. It may also be used in conjunction with live-fire testing.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A dynamic pointing accuracy evaluation system used in conjunction with a weapon system including a gun that fires a projectile from a barrel toward a target upon receipt of a shoot command from an automated fire control system that is activated by a firing command generated by a gunner viewing the target through a gun sight, the dynamic pointing accuracy evaluation system comprising:

a firing-image camera mounted to the barrel of the gun and having a known imaging relation relative to a pointing direction of the barrel of the gun;

a photo trigger command line that transmits a photo trigger command from the fire control system to the firing-image camera, whereupon the firing-image camera produces a firing image upon receipt of the photo trigger command; and a computer that receives the firing image and determines a calculated strike location from the firing image and from a range of the gun to the target.

2. The dynamic pointing accuracy evaluation system of claim 1, wherein the firing-image camera is a digital camera.

3. The dynamic pointing accuracy evaluation system of claim 1, further including;

a range finder that provides to the computer an actual range from the gun to the target associated with the time at which the photo trigger command is transmitted.

4. The dynamic pointing accuracy evaluation system of claim 1, wherein the fire control system generates the photo trigger command at the same time that it generates the shoot command.

5. The dynamic pointing accuracy evaluation system of claim 1, wherein the computer contains a reference image of the target.

6. The dynamic pointing accuracy elevation system of claim 1, further including;

a gun-sight camera that produces a gun-sight image upon receipt of the shoot command and transmits the gun-sight image to the computer.

7. A dynamic pointing accuracy evaluation system used in conjunction with a weapon system including a gun that fires a projectile from a barrel toward a target upon receipt of a shoot command from an automated fire control system that is activated by a firing command generated by a gunner viewing the target through a gun sight, the dynamic pointing accuracy evaluation system comprising:

a digital firing-image camera mounted to the barrel of a gun and having a known imaging relation relative to a pointing direction of the barrel of the gun;

a photo trigger command line that transits a photo trigger command from the fire control system to the firing-image camera at the same time that the fire control system generates the shoot command, whereupon the firing-image camera produces a firing image upon receipt of the photo trigger command;

a range finder that provides to the computer an actual range from the gun to the target associated with the time at which the photo trigger command is transmitted; and a computer that receives the firing image and determines a calculated strike location from the firing image and from a range of the gun to the target.

8. The dynamic pointing accuracy evaluation system of claim 7, wherein the computer contains a reference image of the target.

9. The dynamic pointing accuracy evaluation system of claim 7, further including a gun-sight camera that produces a gun-sight image upon receipt of the shoot command and transmits the gun-sight image to the computer.

10. A dynamic pointing accuracy evaluation system used in conjunction with a weapon system including a gun that fires a projectile from a barrel toward a target upon receipt of a shoot command from an automated fire control system that is activated by a firing command generated by a gunner viewing the target through a gun sight, the dynamic pointing accuracy evaluation system comprising:

a firing-image source having a know imaging relation relative to a pointing direction of the barrel of the gun;

an imaging trigger command line that transmits an imaging trigger command from the fire control system to the firing-image source whereupon the firing-image source produces a firing image upon receipt of the image trigger command; and a computer that receives the firing image and determines a calculated strike location from the firing image and from a range of the gun to the target.

11. A method for evaluating dynamic pointing accuracy used in conjunction with a weapon system including a gun that fires a projectile from a barrel toward a target upon receipt of a shoot command from an automated fire control system that is activated by a firing command generated by a gunner viewing the target through a gun sight, the method comprising the steps of:

the gunner sending a firing command to the automated fire control system;

the automated fire control system;

sending a shoot command to the gun responsive to the firing command, and sending a photo trigger command to a firing-image camera mounted on the barrel of the gun and aimed parallel to a boresight of the gun, responsive to the firing command;

the firing-image camera producing a firing image responsive to the photo trigger command and sending the firing image to a computer; and the computer determining a calculated strike location from the firing image and from a range of the gun to the target.

12. The method of claim 11, wherein the gun is not fired during the performance of the method.

13. The method of claim 11, wherein the step of the firing-image camera producing includes the step of the firing-image camera producing a digital image.

14. The method of claim 11, including an additional steps of providing a range finder, and the range finder automatically providing an actual range from the gun to the target associated with the time at which the photo trigger command is sent to the firing-image camera.

15. The method of claim 11, wherein the fire control system generates the photo trigger command at the same time that it generates the shoot command.

16. The method of claim 11, wherein the computer contains a reference image of the target, and wherein the method further includes:

superimposing the strike location upon the reference image of the target.

17. The method of claim 11, including the additional steps of providing a gun-sight camera that produces a gun-sight image upon receipt of the firing command and transmits the gun-sight image to the computer.

* * * * *

UNITED STATES PATENT AND TRADEMARK OFFICE

CERTIFICATE OF CORRECTION

PATENT NO. : 6,973,865 B1
DATED : December 13, 2005
INVENTOR(S) : Duselis et al.

It is certified that error appears in the above-identified patent and that said Letters Patent is hereby corrected as shown below:

Title page,
Item [75], Inventors, delete "Jesica Renee DeHerdt" and replace with -- Jessica Renee DeHerdt --.

Column 2,
Line 47, delete "life firing" and replace with -- live firing --.

Column 7,
Lines 51-52, delete "so correct" and replace with -- to correct --.

Column 9,
Line 41, delete "having a know" and replace with -- having a known --.
Line 45, delete "firing-image source whereupon" and replace with -- firing-image camera, whereupon --.

Column 10,
Line 30, delete "an additional steps" and replace with -- an additional step --.

Signed and Sealed this

Sixth Day of June, 2006

JON W. DUDAS
*Director of the United States Patent and Trademark Office*